US005529169A

United States Patent [19]

Wilbur et al.

[11] Patent Number: 5,529,169

[45] Date of Patent: Jun. 25, 1996

[54] METHOD FOR AUTOMATED SORTING OF MEAT PRODUCTS USING OUTFEED SEPARATION ROLLER

[75] Inventors: John H. Wilbur; Robert A. Cole, both of Medford; Frank B. Thomason, Grants Pass, all of Oreg.

[73] Assignee: Simco/Ramic Corporation, Medford, Oreg.

[21] Appl. No.: 502,925

[22] Filed: Jul. 17, 1995

Related U.S. Application Data

[63] Continuation-in-part of Ser. No. 307,916, Sep. 16, 1994, abandoned.

[51] Int. Cl.[6] ..... B07C 5/00

[52] U.S. Cl. ..... 209/576; 209/639; 209/640

[58] Field of Search ..... 209/618, 45, 616, 209/639, 644, 700, 932, 933, 691, 616, 689, 656, 640, 642

[56] References Cited

U.S. PATENT DOCUMENTS

| | | | |
|---|---|---|---|
| 3,750,882 | 8/1973 | Hays | 209/639 X |
| 3,757,946 | 9/1973 | Berkowitz et al. | 209/639 |
| 3,930,991 | 1/1976 | Gillespie . | |
| 3,977,526 | 8/1976 | Gordon et al. | 209/639 X |
| 3,990,581 | 11/1976 | Tengsater | 209/640 X |
| 4,018,674 | 4/1977 | Morris | 209/639 X |
| 4,195,735 | 4/1980 | Facchinelli | 209/640 X |
| 4,375,853 | 3/1983 | Feller et al. | 209/640 |
| 4,405,126 | 9/1983 | Frye et al. | 209/639 X |
| 4,889,241 | 12/1989 | Cogan et al. | 209/639 X |
| 5,048,674 | 9/1991 | Wilbur et al. | 209/639 X |
| 5,090,576 | 2/1992 | Menten | 209/639 X |
| 5,215,772 | 6/1993 | Roth . | |
| 5,339,965 | 8/1994 | Klukis et al. | 209/639 |
| 5,431,289 | 7/1995 | Hoffman | 209/639 X |

*Primary Examiner*—D. Glenn Dayoan
*Attorney, Agent, or Firm*—Stoel Rives

[57] ABSTRACT

The present invention provides a method for sorting meat chunks of variable fat and lean meat content, in which some of the meat chunks are interconnected by stringy tissue, the method including providing a roller located above a separation panel separating a lean meat outfeed location and a fat meat outfeed location, the roller being rotatable about a central axis in either a clockwise or counter-clockwise direction to actively displace interconnected meat chunks striking the roller into either the lean meat outfeed location or the fat meat outfeed location and prevent build-up of interconnected meat chunks on the separation panel.

10 Claims, 2 Drawing Sheets

METHOD FOR AUTOMATED SORTING OF MEAT PRODUCTS USING OUTFEED SEPARATION ROLLER

CROSS REFERENCE TO RELATED APPLICATION

This application is a continuation-in-part of U.S. application No. 08/307,916, filed Sep. 16, 1994, now abandoned.

TECHNICAL FIELD OF THE INVENTION

The present invention relates generally to automated bulk processing equipment for inspecting and sorting articles and, in particular, to systems for separating articles sorted by such equipment.

BACKGROUND OF THE INVENTION

Automated bulk processing equipment rapidly sorts bulk articles including meat chunks, raw or processed fruit, vegetables, wood chips, recycled plastics and other similar products. Typically, articles are moved along a conveyor and inspected optically by means of a photo-electric detector. The articles can be characterized and sorted according to size, color, shape or other qualities. For example, stems and debris can be separated from fruit, fruit and vegetables can be reliably graded and sorted, lean meat chunks can be separated from fat meat chunks, and discolored or otherwise defective articles can be separated. Modern bulk optical processing equipment can rapidly separate very large quantities of articles into numerous categories.

Such equipment typically includes a conveyor system that moves articles in a single layer past an inspection station where cameras or other detection devices examine the articles. The inspection station sends signals to a sorting or treatment station where the articles are sorted or otherwise treated according to information received from the inspection station. For example, foreign or defective articles may be removed from the flow of articles carried by the conveyor system. Frequently, unacceptable articles are removed by directing an accurately timed blast of fluid, such as compressed air, at the article as it is projected from the conveyor belt in order to direct it out of the process flow. Separation takes place at a location in the transport system where the articles are unsupported so that defective articles can easily be removed from the stream. Acceptable articles are collected in a product outfeed location such as a product outfeed chute, while unacceptable articles are directed into a reject outfeed location such as a reject outfeed chute.

One type of conventional automated bulk processing system is illustrated in FIG. 1. Articles are delivered to conveyor belt 10 moving in direction 12 by infeed system 14. Conveyor belt 10 travels at a velocity high enough to project articles from the conveyor belt 10 in a trajectory 16 toward product outfeed chute 18. The articles pass through an inspection station 20 comprising light modules 22 and 22' operably connected to camera module 24. Unacceptable articles are removed from the flow of articles along trajectory 14 by means of a fluid blast from a fluid ejection manifold 26 which directs the article in a direction 28 out of the trajectory 16. An elongated flat separation panel 30 separates product outfeed chute 18, where acceptable articles are collected, from reject outfeed chute 32.

During processing of meat, trim pieces of meat are produced which typically contain about 50% fat and 50% lean meat. In order to render this meat acceptable for human consumption in hamburgers, hot dogs, etc., the fat content must be reduced to about 25%, generally by adding lean meat to the 50% fat mixture. In order to achieve this lowering of fat content, trim meat pieces having lean meat portions and fat meat portions are first divided into smaller sized, preferably cubic, meat chunks of higher lean meat content and meat chunks of higher fat content, by means of an automated cutter. The meat chunks are passed through an inspection station where an optical property related to either the lean meat content or fat content of the chunks is detected. Meat chunks of high lean content are then separated from meat chunks of high fat content and are directed into either a lean meat outfeed chute or a fat meat outfeed chute, separated by a separation panel.

Due to the randomness of the shape of the trim meat pieces and the mixed lean and fat composition of the trim meat pieces prior to cutting, the output of the automatic cutter tends to be somewhat random. As a result, the meat chunks are not perfect cubes and successive meat chunks are often connected by stringy tissue. These interconnected meat chunks frequently wrap across the edge of the separation panel between the lean meat outfeed chute and the fat meat outfeed chute. Over time, the build-up of meat chunks on the separation panel blocks the flow of product through the sorting station, causing the equipment to jam.

SUMMARY OF THE INVENTION

An objective of the present invention is therefore to provide a sorting station for use in automated bulk meat processing equipment that improves the accuracy and efficiency of meat sorting operations.

Another objective of the present invention is to prevent interconnected meat chunks from wrapping across the upper edge of the panel separating the lean meat outfeed location and the fat meat outfeed locations, thereby preventing build-up which can cause reduced sorting efficiency.

A further objective of the present invention is to selectively control the yield versus quality, or percentage fat, of meat chunks collected in the lean meat out:feed location.

These and other objectives are achieved according to the present invention by providing an outfeed separation roller positioned above the panel separating the lean meat outfeed location from the fat meat outfeed location. The separation roller is driven by a motor and continuously rotates about a central axis in either a clockwise or counter-clockwise direction, the direction of rotation being selected according to the desired fat content of the lean meat product.

In a typical arrangement, meat chunks are projected from a conveyor belt to form a meat chunk flow path and traverse an inspection station where meat chunks having a high fat content are identified. The meat chunk flow path then traverses an unacceptable article removal station, where meat chunks having a high fat content are deflected down by a fluid blast from a fluid ejection manifold and fall either into the fat meat outfeed location or across the outfeed separation roller.

The direction of rotation of the roller then controls delivery of meat chunks contacting the roller into either the lean meat outfeed or fat meat outfeed locations. The direction of roller rotation is adjustable and depends upon the objective of the process. For sorting applications where reduction of the fat content of the lean meat stream is the primary objective, the roller is rotated toward the fat meat outfeed location to ensure that all meat chunks having a high fat content are removed from the lean meat flow. For sorting operations where the primary objective is yield, and the percentage of fat present in the lean meat product is of secondary consideration, the roller is rotated towards the lean meat outfeed location. In this mode, the roller functions mainly to ensure that any meat chunks which fall across the boundary between the lean meat outfeed and fat meat outfeed chutes will not accumulate and cause the equipment to jam.

The above-mentioned and additional features of the present invention and the manner of obtaining them will become apparent, and the invention will be best understood by reference to the following more detailed description, read in conjunction with the accompanying drawings.

DESCRIPTION OF PREFERRED EMBODIMENTS

Figure 1:
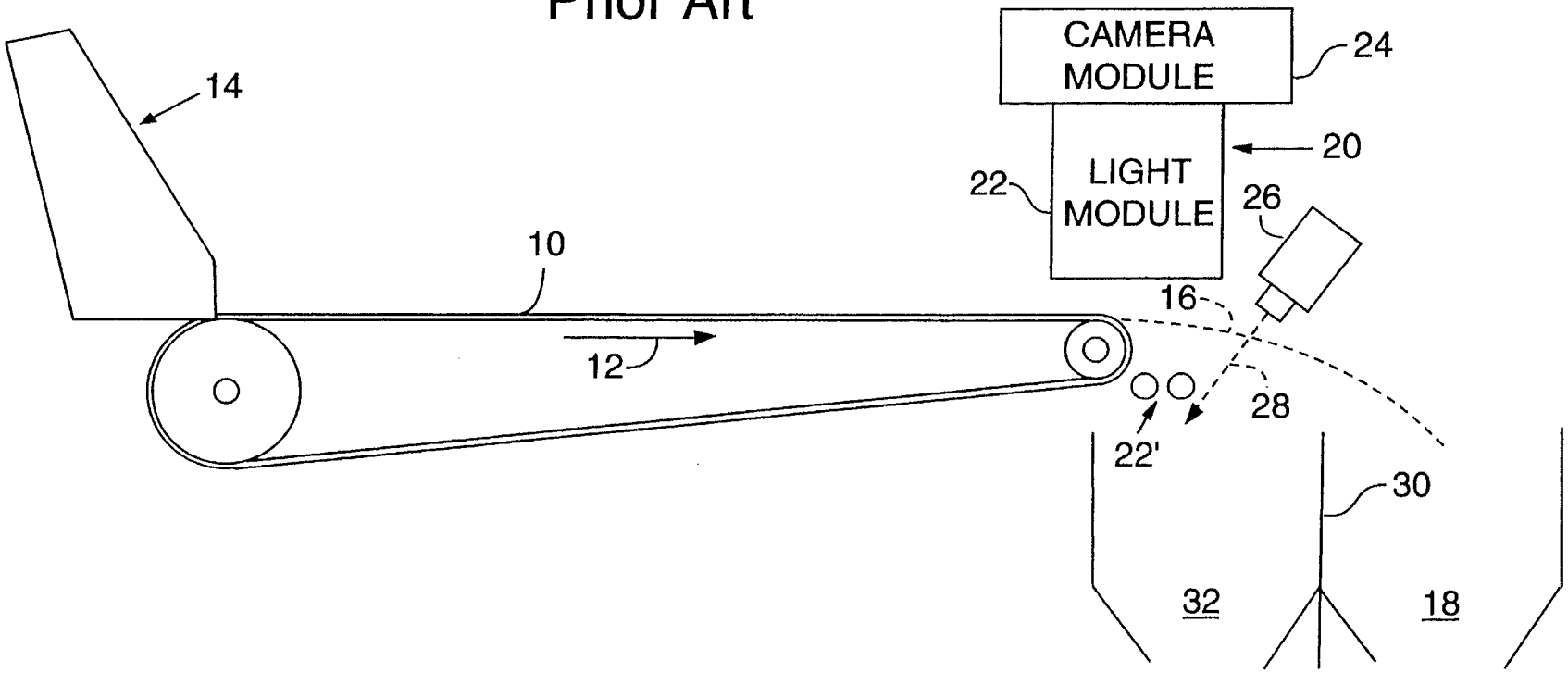
FIG. 1 Prior Art
FIG. 1 is a schematic side view representation of an automated bulk processing system including a conventional separation station.
Figure 2:
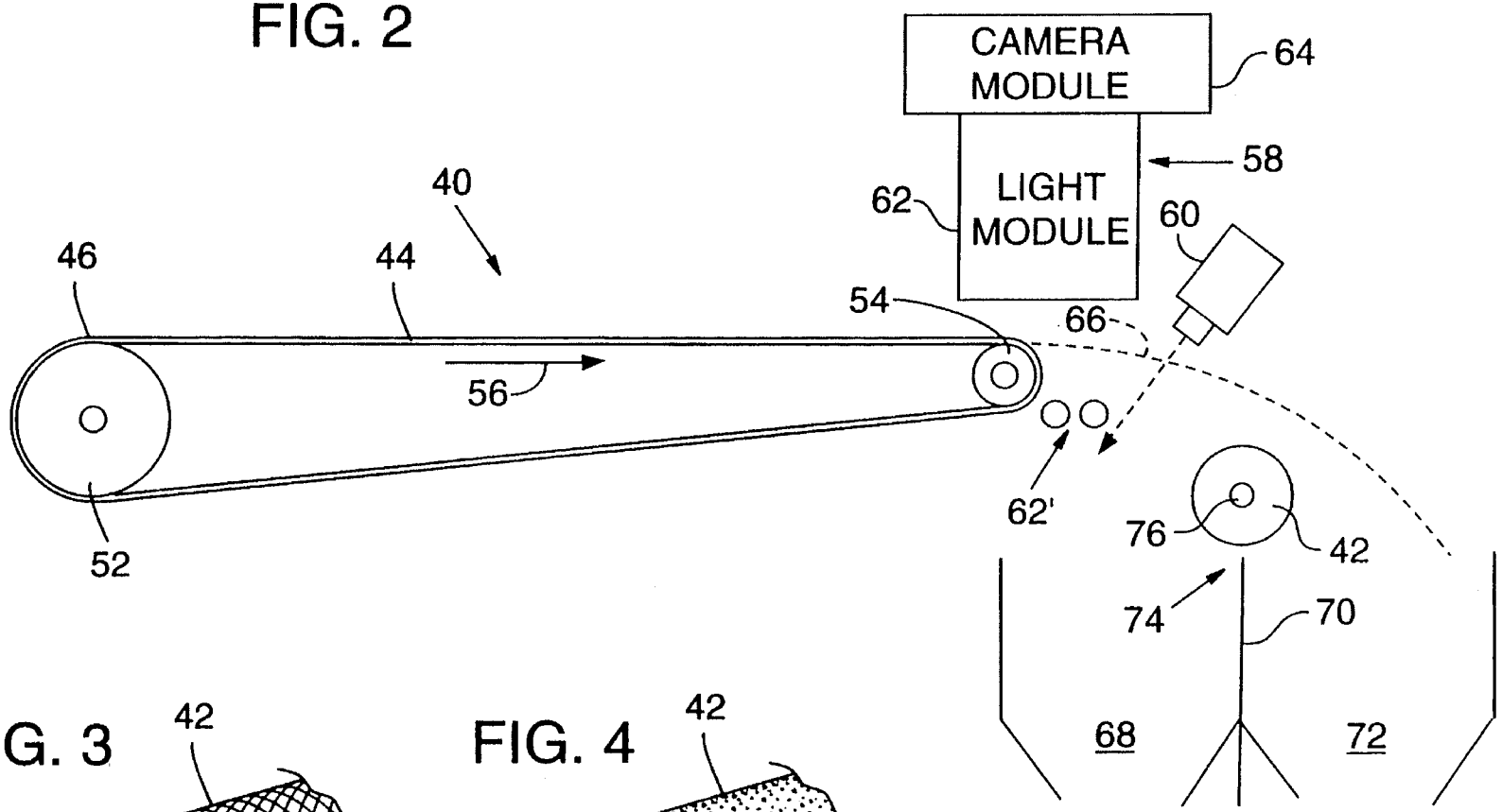
FIG. 2 is a schematic side view representation of an automated bulk meat processing system of the present invention having an outfeed separation roller located between the lean meat outfeed and fat meat outfeed chutes.
Figure 4:
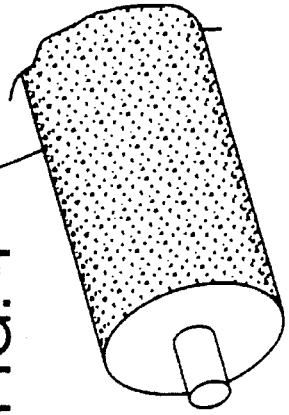
FIG. 4 is a fragmentary isometric view of the separation roller with a grit surface.
Figure 3:
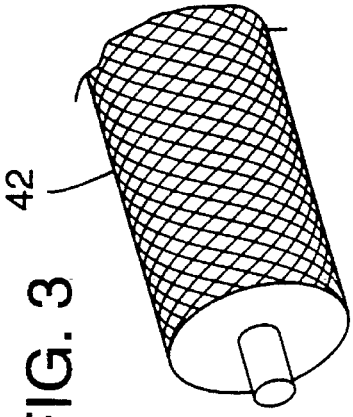
FIG. 3 is an fragmentary isometric view of the separation roller with a knurled surface.

An automated bulk meat processing system 40 having an outfeed separation roller 42 according to the present invention is illustrated in FIG. 2. The processing system preferably performs optical inspection and sorting of bulk quantities of meat chunks having variable fat content.

Pre-cut meat chunks, preferably one inch cubes, are delivered to end 46 of conveyor belt 44 by an infeed system (not shown). Infeed systems suitable for use in meat sorting operations are well known in the art, and include infeed conveyor belts and vibrating chutes. Conveyor belt 44 forms a closed loop around a drive roller 52 and a spaced-apart, free-running end roller 54. A motor (not shown) coupled to drive roller 52 drives an upper surface of belt 44 at a velocity in a direction 56 toward an optical inspection station 58 and an unacceptable article removal station 60.

In a preferred embodiment, inspection station 58 includes a pair of light modules 62 and 62' that cooperate with a camera module 64 to identify preselected optical properties related to the lean meat or fat content of the meat chunks as they pass from conveyor belt 44. Inspection station 58 can identify the preselected optical properties of the meat chunks in accordance with the methods and systems described in U.S. Pat. No. 5,085,325 of Jones et al. for Color Sorting System and Method, assigned to the assignee of the present application, which is hereby incorporated by reference. Although inspection station 58 is shown as illuminating and inspecting meat chunks after they pass from belt 44 (i.e., off-belt operation), outfeed separation roller 42 is also useful in inspection systems that employ on-belt inspection. Other inspection systems known in the art could alternatively be used in the present invention.

Unacceptable article removal station 60 preferably comprises a fluid ejection manifold which employs pressurized fluid to divert meat chunks having a high fat content projected along an outfeed trajectory 66 extending from belt 44 towards fat meat outfeed chute 68. The fluid ejection manifold is generally provided with a series of fixed or adjustable nozzles capable of accurately directing a blast of pressurized fluid, preferably compressed gas and most preferably compressed air. Adjustment of the nozzles and timing of fluid blasts can be controlled, for example, by a sorting control system that is integrated with the inspection system.

A separation panel 70 separates fat meat outfeed chute 68 from lean meat outfeed chute 72. Outfeed separation roller 42 is positioned above end 74 of separation panel 70 and is driven by a motor (not shown) to rotate about an axis 76 in clockwise or counter-clockwise directions. Outfeed separation roller 42 preferably has a surface with moderate friction such as a knurled or grit material coating to facilitate transfer of meat chunks that contact the roller. While the embodiment of the present invention described herein employs outfeed chutes for collecting lean and fat meat chunks, other collection devices, such as bins or secondary conveyors, can also be used with the present invention.

The meat processing and sorting is preferably carried out at temperatures around 35° C. In operation, meat chunks are transported on conveyor belt 44 in direction 56 at a high enough velocity to project the meat chunks from the edge of conveyor belt 44 in trajectory 66. As meat chunks are projected from conveyor belt 44, they traverse inspection station 58. Meat chunks having a high lean content continue along trajectory 66 into lean meat outfeed chute 72. Meat chunks having a high fat content are removed from the meat chunk flow path at removal station 60 by a fluid blast. The fluid blast will cause some interconnected meat chunks to become draped over outfeed separation roller 42. When roller 42 is rotating toward fat meat outfeed chute 68, meat chunks are actively drawn into the fat meat outfeed chute even though a substantial portion of the interconnected chunks may be in lean meat outfeed chute 72. Conversely, when roller 42 is rotating towards lean meat outfeed chute 72, meat chunks are actively drawn into the lean meat outfeed chute.

Outfeed separation roller 42 operates in a field-reversible manner. In sorting operations in which maximum lean meat content and minimal fat content of the meat chunks delivered to lean meat outfeed chute 72 is the primary objective, roller 42 is driven toward fat meat outfeed chute 68 so that meat chunks which strike roller 42 are drawn toward the fat meat outfeed chute. Alternatively, in sorting operations in which a high yield of meat chunks is the primary objective, roller 42 is driven towards lean meat outfeed chute 72 so that meat chunks are drawn into the lean meat outfeed chute. It will be appreciated that in either mode of operation, interconnected meat chunks will not accumulate on separation roller 42, thereby reducing the likelihood of the separation system becoming clogged.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

We claim:

1. A method of sorting meat chunks of variable fat and lean meat content wherein some of the meat chunks are interconnected by stringy tissue, the method comprising:

(a) conveying the meat chunks to an optical inspection station;

(b) sensing an optical property related to the fat and lean meat content of the meat chunks;

(c) directing meat chunks having a high lean meat content towards a lean meat outfeed location and directing meat chunks having a high fat content towards a fat meat outfeed location, the lean meat outfeed location and the fat meat outfeed location being separated by a separation panel; and (d) providing a roller located above the separation panel, the roller being rotatable about a central axis in either a clockwise or a counter-clockwise direction, to actively displace interconnected meat chunks striking the roller into either the lean meat outfeed location or the fat meat-outfeed location and prevent build-up of interconnected meat chunks on the separation panel.

2. The method of claim 1, wherein the roller has a non-smooth surface.

3. The method of claim 2, wherein the roller has a knurled surface.

4. The method of claim 2, wherein the roller has a grit surface.

5. The method of claim 1 wherein the roller is rotated towards the lean meat outfeed location to increase yield of meat chunks received in the lean meat outfeed location.

6. The method of claim 1 wherein the roller is rotated towards the fat meat outfeed location to increase the lean meat content of meat chunks received in the lean meat outfeed location.

7. The method of claim 1 wherein meat chunks having a high fat content are directed towards the fat meat outfeed location by means of a fluid blast from a fluid ejection manifold.

8. The method of claim 7, wherein the fluid blast is a compressed air blast.

9. The method of claim 1, wherein the meat chunks are conveyed towards the optical inspection station along an article flow path and the optical inspection station comprises a first and a second light module, the first light module being located above the flow path of the meat chunks and the second light module being located below the flow path of the meat chunks.

10. In a method for sorting meat chunks of variable fat and lean meat content wherein some of the meat chunks are interconnected by stringy tissue, in which the meat chunks are conveyed to an optical inspection station, an optical property related to the fat and lean meat content of the meat chunks is sensed, meat chunks having a high lean meat content are directed towards a lean meat outfeed location and meat chunks having a high fat content are directed towards a fat meat outfeed location, the lean meat outfeed location and the fat meat outfeed location being separated by a separation panel, the improvement comprising providing a roller located above the separation panel, the roller being rotatable about a central axis in either a clockwise or a counter-clockwise direction, to actively displace interconnected meat chunks striking the roller into either the lean meat outfeed location or the fat meat outfeed location and prevent build-up of interconnected meat chunks on the separation panel.

* * * * *